US006328088B1

(12) United States Patent
Draghetti

(10) Patent No.: US 6,328,088 B1
(45) Date of Patent: Dec. 11, 2001

(54) DEVICE FOR SPLICING STRIPS OF THERMOPLASTIC MATERIAL

(75) Inventor: Fiorenzo Draghetti, Medicina (IT)

(73) Assignee: G. D Societa per Azioni, Bologna (IT)

( * ) Notice: Subject to any disclaimer, the term of this patent is extended or adjusted under 35 U.S.C. 154(b) by 0 days.

(21) Appl. No.: 09/356,827

(22) Filed: Jul. 19, 1999

(30) Foreign Application Priority Data

Jul. 21, 1998 (IT) ..... BO98A0450

(51) Int. Cl.[7] ..... B65H 21/00

(52) U.S. Cl. ..... 156/504; 156/159; 156/502; 242/552; 242/553

(58) Field of Search ..... 156/157, 159, 156/502, 504, 507; 242/551, 552, 553, 555.1, 555.5, 555.6, 556

(56) References Cited

U.S. PATENT DOCUMENTS

| | | | | |
|---|---|---|---|---|
| 2,724,426 | | 11/1955 | Bell et al. | 154/42 |
| 3,610,547 | * | 10/1971 | Anderson | 242/556 X |
| 3,769,124 | * | 10/1973 | Johnson | 156/159 |
| 4,815,405 | * | 3/1989 | Young, Jr. | 242/556 X |
| 5,273,228 | * | 12/1993 | Yoshida et al. | 156/157 X |
| 5,318,646 | * | 6/1994 | Cardini et al. | 156/157 |
| 5,411,223 | * | 5/1995 | Gatteschi | 242/551 |
| 5,618,377 | * | 4/1997 | Kaneko et al. | 156/504 |
| 5,669,998 | * | 9/1997 | Ward et al. | 156/159 |
| 5,863,381 | * | 1/1999 | Magota et al. | 156/507 |

FOREIGN PATENT DOCUMENTS

| | | |
|---|---|---|
| 19607495 | 9/1997 | (DE) . |
| 2260532 | 4/1993 | (GB) . |

OTHER PUBLICATIONS

Derwent Abstract of 19607495 Dated Sep. 18, 1997.

* cited by examiner

*Primary Examiner*—Mark A. Osele
(74) *Attorney, Agent, or Firm*—Ladas & Parry

(57) ABSTRACT

A device for splicing strips of thermoplastic material to splice a first strip extending along a first path and a second strip extending along a second path; the device having first guides for guiding the first strip, and second guides for guiding the second strip, the first and second guides being movable with respect to each other to bring together a portion of the first strip and a portion of the second strip; a heat-seal block movable between a rest position and a work position to grip and heat seal the portions of the first and second strips between the heat-seal block and the second guides; and a heatable element which is movable to intercept a portion of at least one of the first and second strips and cut the strip by melting the portion of the strip contacting the element.

7 Claims, 8 Drawing Sheets

DEVICE FOR SPLICING STRIPS OF THERMOPLASTIC MATERIAL

FIELD OF THE INVENTION

The present invention relates to a device for splicing strips of thermoplastic material.

More specifically, the present invention relates to a device for splicing strips of thermoplastic material on a machine for conditioning packets of cigarettes, to which the following description refers purely by way of example.

BACKGROUND OF THE INVENTION

On machines for conditioning packets of cigarettes, the finished packets of cigarettes are wrapped in an overwrapping, normally comprising a sheet of polypropylene, to protect the cigarettes from the atmosphere. The sheets are formed from a strip of polypropylene, which is unwound of a reel and guided to a cutting station upstream from a folding station, and are cut off the strip, which is held taut by supporting and guide elements, as the strip is fed forward.

Given the extremely high output rate, and hence high strip consumption, of modern cigarette conditioning machines, these are equipped with automatic reel-change and strip splicing devices.

The reel-change device provides for replacing the running-out reel with a new one, and the splicing device for joining the strip on the new reel to that of the running-out reel and so ensuring continuity between the strips on the two reels without interrupting the wrapping work on the machine, which, pending splicing of the strips, is supplied by a strip store downstream from the splicing device.

Splicing the strips involves cutting the strip on the running-out reel and a surplus strip portion on the new reel by means of respective cutters, the respective blades of which are brought into contact with the respective strips and with respective counterblades.

Though satisfactory, splicing devices of the above type are structurally complex on account of the blades and respective counterblades. In addition to which, the blades require frequent sharpening and, consequently, frequent adjustment of the position of the blades with respect to the counterblades.

SUMMARY OF THE INVENTION

It is an object of the present invention to provide a device for splicing strips of thermoplastic material, designed to eliminate the aforementioned drawbacks, and which, in particular, involves less maintenance.

According to the present invention, there is provided a device for splicing strips of thermoplastic material to splice at least a first strip extending along a first path, and a second strip extending along a second path; the device comprising first supporting and guide means for the first strip, and second supporting and guide means for the second strip, the first and second supporting and guide means being movable with respect to each other to bring together a portion of the first strip and a portion of the second strip; a heatseal block movable between a rest position and a work position to grip and heat seal said portions of the first and second strips between said heat-seal block and said second supporting and guide means; and movable cutting means for intercepting and cutting at least one of said first and second strips; said device being characterized in that said cutting means comprise a heatable element which is brought into contact with said strip to melt a portion of the strip.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
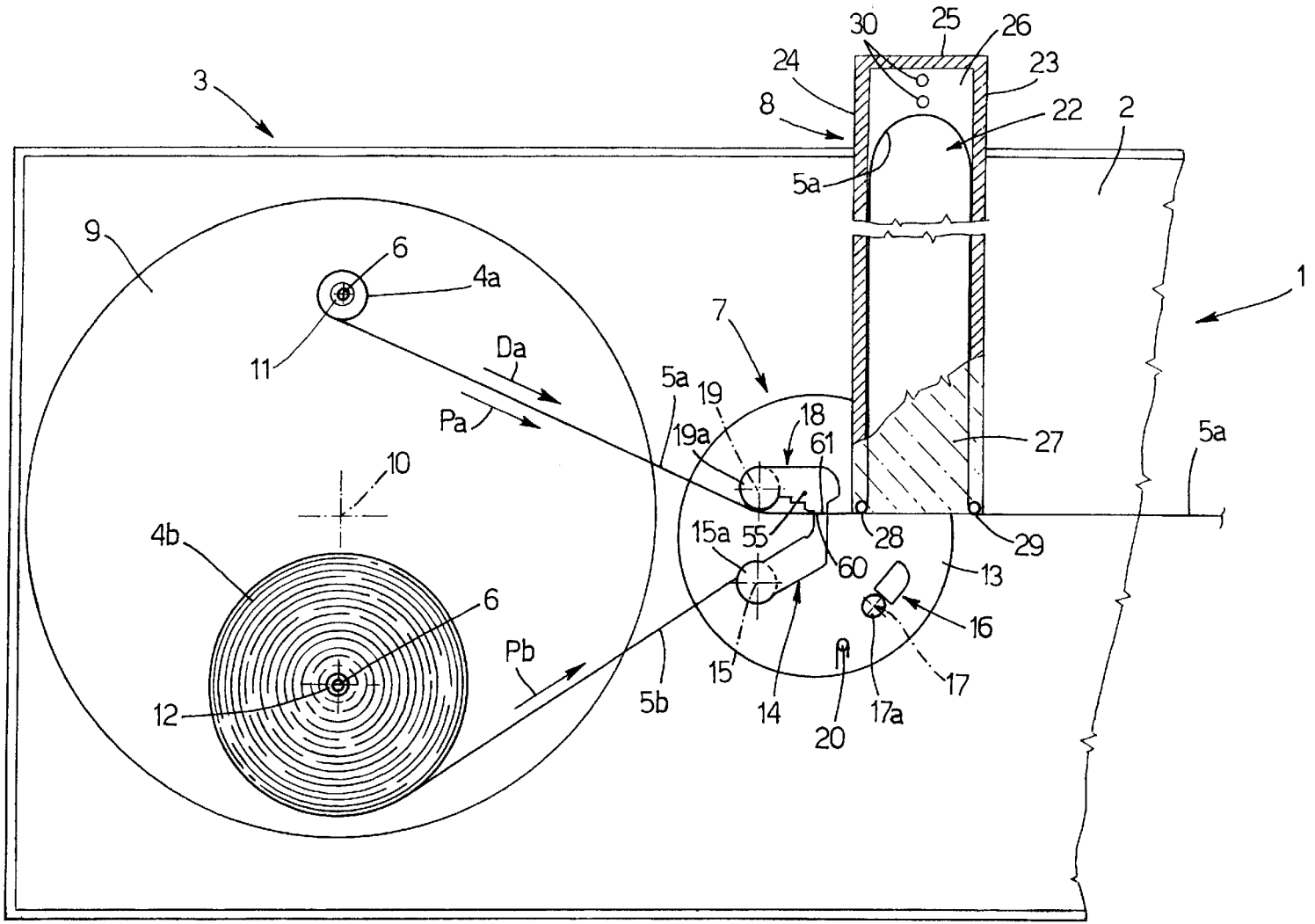
FIG. 1 shows a schematic side view of a machine for cellophaning packets of cigarettes and comprising two preferred embodiments of a device for splicing strips of thermoplastic material in accordance with the present invention.

Number 1 in FIG. 1 indicates a machine for cellophaning known packets of cigarettes (not shown).

Machine 1 comprises a frame 2 to which are fitted successively from left to right in FIG. 1 : a reel-change device 3, which acts on reels 4*a*, 4*b* defined by respective strips 5*a*, 5*b* of thermoplastic material wound about respective cores 6; a splicing device 7 for splicing strips 5*a*, 5*b*; and a compensating store 8 for at least one of strips 5*a*, 5*b*.

Device 3 comprises a platform 9, which rotates, anticlockwise in FIG. 1, about an axis 10 perpendicular to the FIG. 1 plane, and supports a pin 11 and a pin 12 parallel to and on either side of axis 10. Pin 11 supports a running-out reel 4*a*, and pin 12 a new reel 4*b* located below reel 4*a* in FIG. 1.

Splicing device 7 comprises a circular plate 13 fitted to frame 2 and supporting a lever 14, which comprises a pin 15*a* rotating about an axis 15 perpendicular to the FIG. 1 plane, and provides for supporting and guiding strip 5*b* of new reel 4*b*.

Device 7 also comprises a cutting tool 16 fitted to plate 13, alongside lever 14, and rotating about an axis 17 parallel to axis 15; and a cutting and heat-seal tool 18 fitted to plate 13, above lever 14, and which comprises a pin 19*a* rotating about a respective axis 19 parallel to axis 15.

Device 7 also comprises a pin 20, which is fitted to plate 13, below lever 14, extends parallel to axis 15, and in turn comprises suction holes 21 for retaining one end of strip 5*b*, as shown more clearly in FIGS. 3, 6 and 8.

Store 8 comprises an elongated chamber 22 extending in a vertical direction and comprising two lateral walls 23 and 24, an end wall 25, a rear wall 26, and a transparent front wall 27. At the respective bottom ends, lateral walls 23 and 24 have respective beveled edges 29 and 28 for guiding strip 5*a*.

Suction holes 30 are formed in end wall 25 and along rear wall 26 to produce a vacuum inside chamber 22; and strip 5*a* is sucked by the vacuum in chamber 22 onto lateral walls 23 and 24, between which, strip 5*a* forms a bend, the position of which varies according to the difference in the strip supply speeds up- and downstream from store 8. Store 8 is substantially used during the splicing of strips 5*a* and 5*b*, when supply of strip 5*a* is arrested temporarily, and the wrapping operations on machine 1 are continued using strip 5*a* in store 8.

During operation of machine 1, strip 5*a* is unwound off reel 4*a* and fed through splicing device 7 and chamber 22 to cutting and folding devices (not shown) on machine 1. That is, strip 5*a* extends, in a traveling direction Da from left to right in FIG. 1, along an unwinding path Pa defined partly by reel 4*a*, partly by cutting and heat-seal tool 18, and partly by chamber 22. Reel 4*a*, tool 18 and chamber 22 also provide for guiding strip 5*a* along path Pa.

Strip 5*b* extends along a path Pb between reel 4*b* and splicing device 7, with strip 5*b* resting on lever 14, and with the end of the strip contacting pin 15*a*. That is, the operator takes the end of strip 5*b* from reel 4*b*, and places strip 5*b* on lever 14 and the end of the strip on pin 15*a* along path Pb pending splicing to strip 5*a*.

In actual use, as it is about to run out, reel 4*a* is arrested by a known control device (not shown) to arrest supply of strip 5*a* at splicing device 7, which provides for splicing strip 5*b* to strip 5*a*, and for cutting strip 5*a* between reel 4*a* and the splice.

Supply of strip 5*b* is then activated; platform 9 rotates anticlockwise to set reel 4*b* to the position previously occupied by reel 4*a*; and the runout reel 4*a* is removed off pin 11 and replaced by a new reel (not shown).

Figure 2:
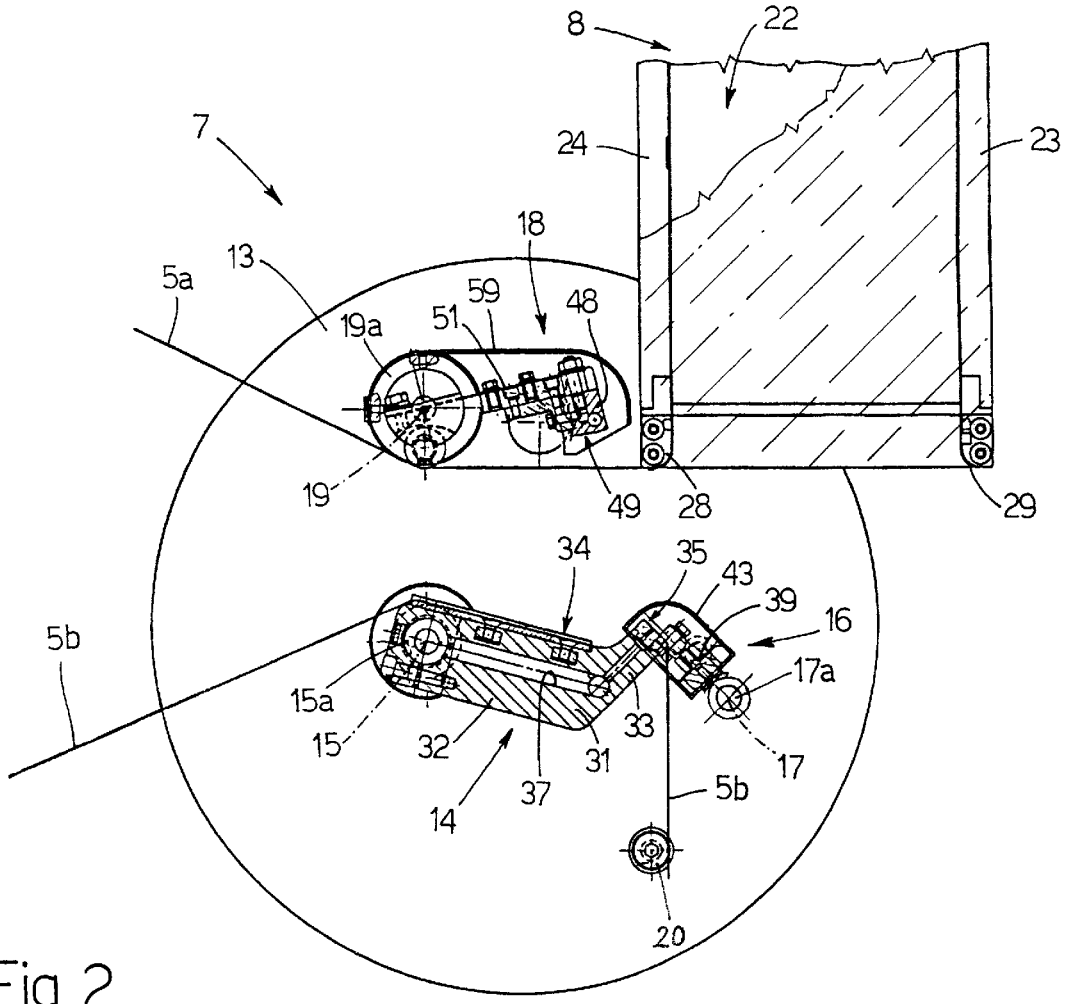
FIGS. 2, 3, 4, 5, and 6 show schematic side views of the FIG. 1 device in different operating positions.
Figure 2A:
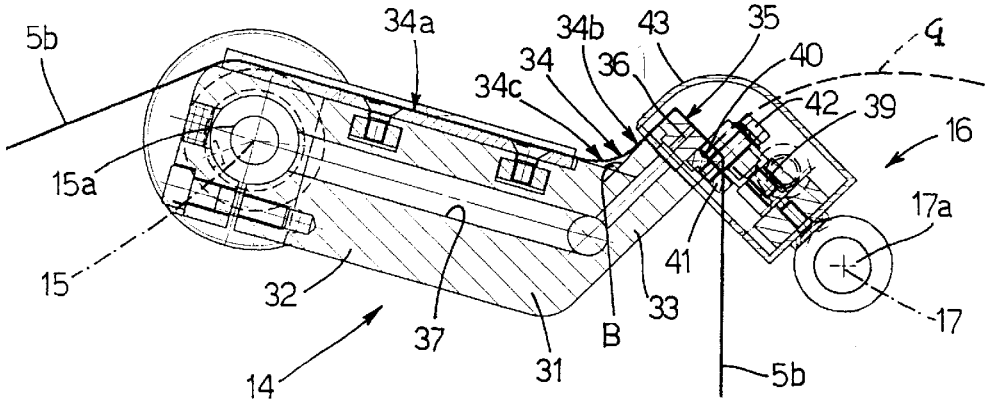
FIGS. 2*a*, 3*a*, 4*a*, 5*a*, 6*a* show schematic side views of details of the FIG. 1 device in the respective FIG. 2 to 6 operating positions.

With reference to FIGS. 2 and 2*a*, lever 14 is set to a standby position and comprises a curved arm 31, which in turn comprises an arm portion 32 extending radially with respect to axis 15 and connected to pin 15*a* coaxial with axis 15, and an arm portion 33 sloping anticlockwise with respect to, and forming a given angle B with, arm portion 32.

Arm 31 defines a lateral supporting surface 34 having suction holes (not shown) for retaining strip 5*b*; and an end surface 35 having suction holes 36 connected to a suction conduit 37 extending inside arm 31 and connected to a known suction device (not shown).

Figure 3:
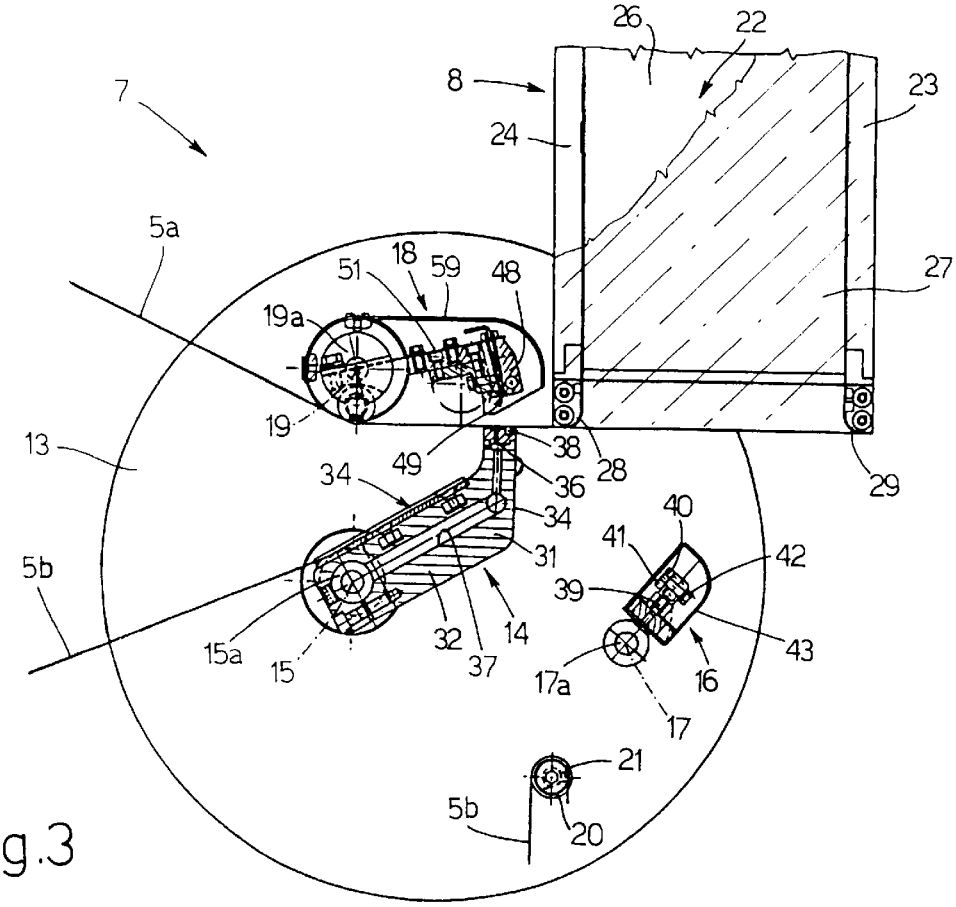
Figure 3A:
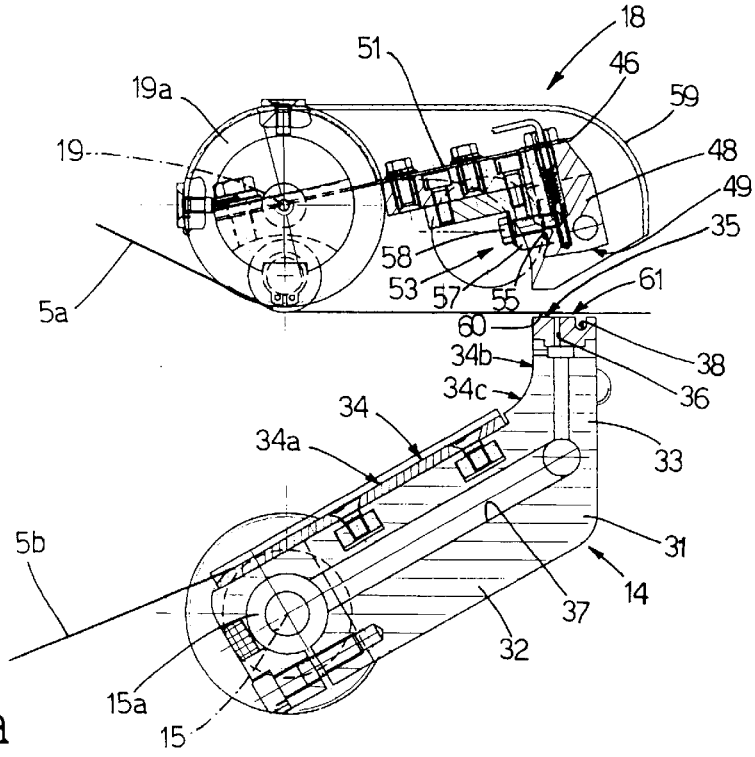

A groove 38 (FIG. 3*a*) is formed inside arm portion 33 and along end surface 35, and extends in a direction perpendicular to the FIG. 3*a* plane.

Surface 34 comprises a flat portion 34*a* extending along portion 32; and a flat portion 34*b*, which extends along portion 33, is connected to portion 34*a* by a curved portion 34*c*, and forms a substantially right angle with end surface 35.

As shown in FIGS. 2 and 2*a*, cutting tool 16 comprises two arms 39 (only one shown in FIG. 2), which extend radially with respect to respective axis 17, are fitted to a pin 17*a* coaxial. with axis 17, and have respective free ends between which is placed a wire 40 of conducting material, which is supplied with electric current to heat wire 40 to a temperature ranging between 100° C. and 150° C. The ends of wire 40 are gripped by respective insulating blocks 41 located at the ends of respective arms 39 and tightened by screws 42.

Tool 16 also comprises a fume hood 43 fitted to pin 17*a* and located over arms 39.

Arms 39 rotate about axis 17 between a rest position, as shown in FIGS. 3 and 3*a*, and a work position, as shown in FIGS. 2 and 2*a*.

When passing from the rest to the work position, wire 40 is positioned at end surface 35 of lever 14, with lever 14 in the standby position, and engages groove 38 with arms 39 on either side of lever 14. Electric current is supplied to wire 40 by known components (not shown), and each block 41 insulates wire 40 electrically and thermally from the other components of tool 16.

In FIGS. 3 and 3*a*, lever 14 is set to the work position with strip 5*b* positioned for heat sealing to strip 5*a*, and with cutting tool 16 and cutting and heat-seal tool 18 set to the rest position.

Figure 7:
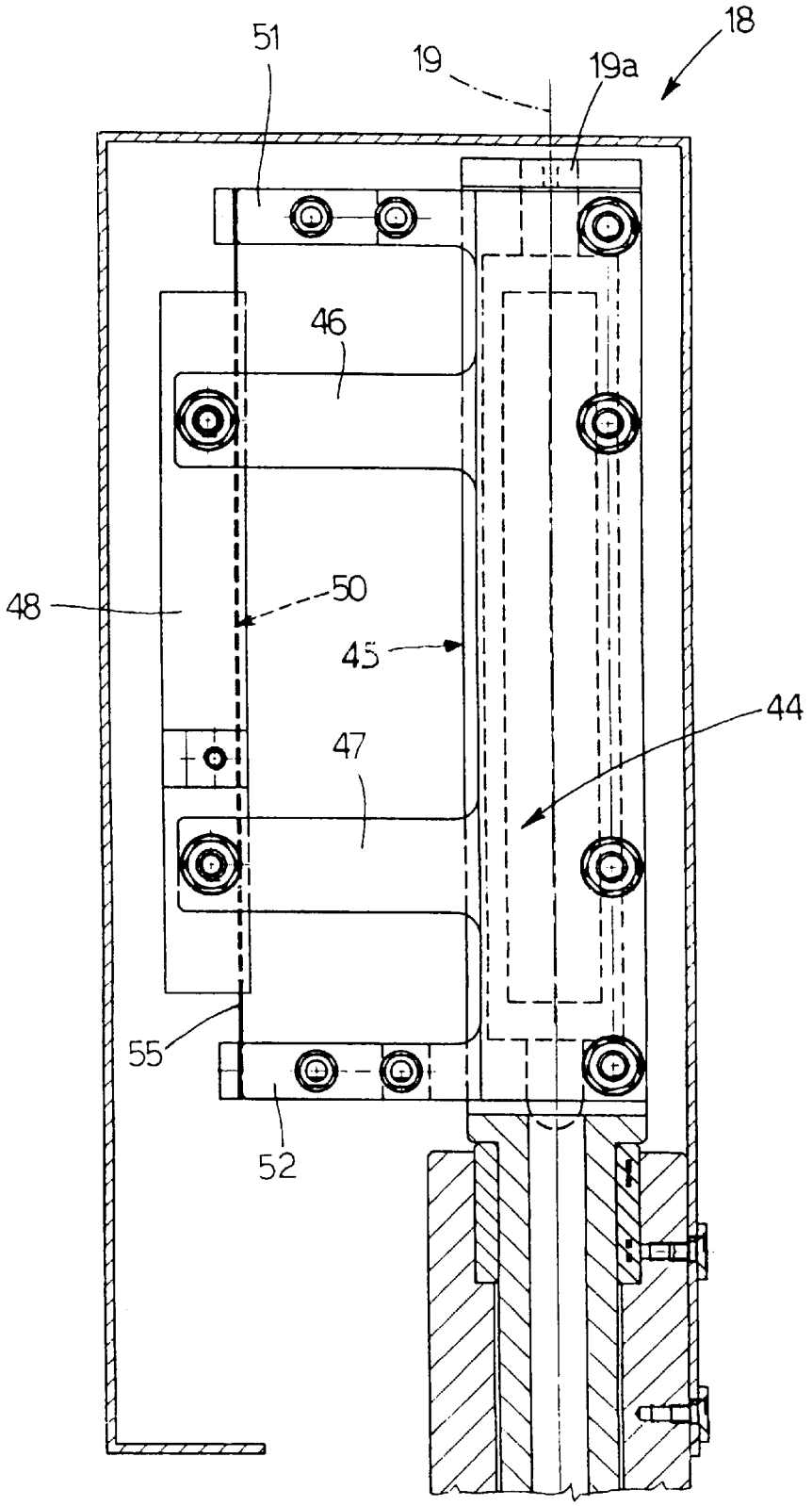
FIG. 7 shows a plan view, with parts removed for clarity, of a detail of the device according to the invention.

As shown more clearly in FIG. 7, tool 18 comprises a substantially U-shaped, flexible blade 44 having a base 45 projecting with respect to pin 19*a* coaxial with axis 19, and two appendixes 46 and 47, to the ends of which is fitted a heat-seal block 48 having a curved heat-seal surface 49 (FIGS. 3 and 3*a*), the generating lines of which are perpendicular to the FIG. 3*a* plane and parallel to axis 19. The face of heat-seal block 48 facing axis 19 comprises a groove 50 parallel to axis 19 and extending along the whole of block 48.

Figure 4:
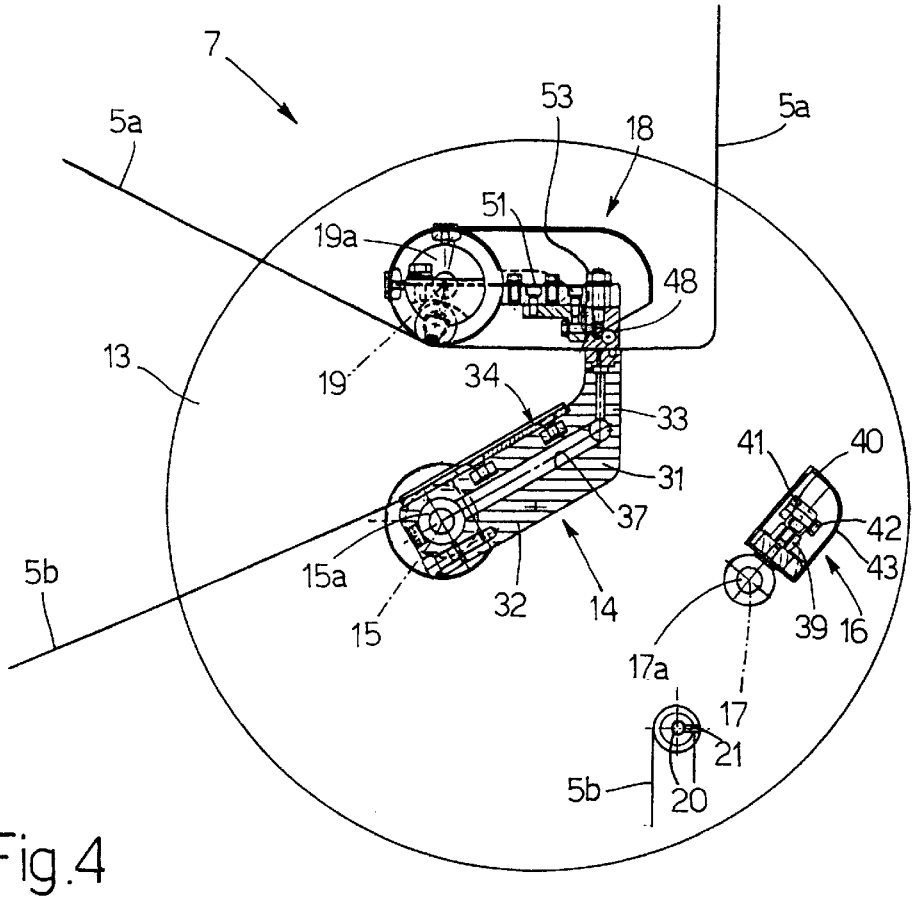
Figure 4A:
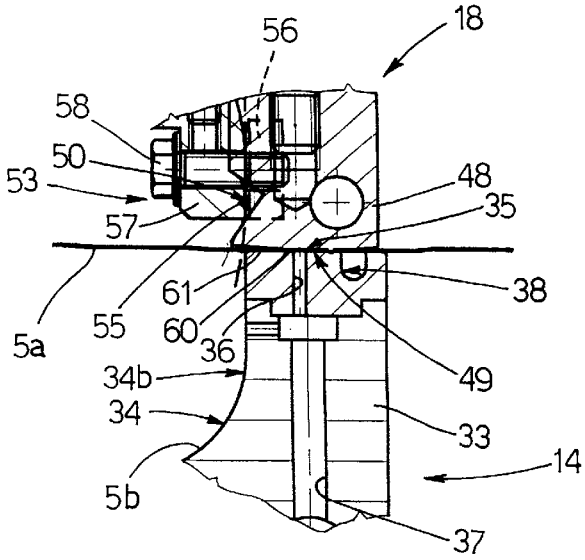
Figure 5:
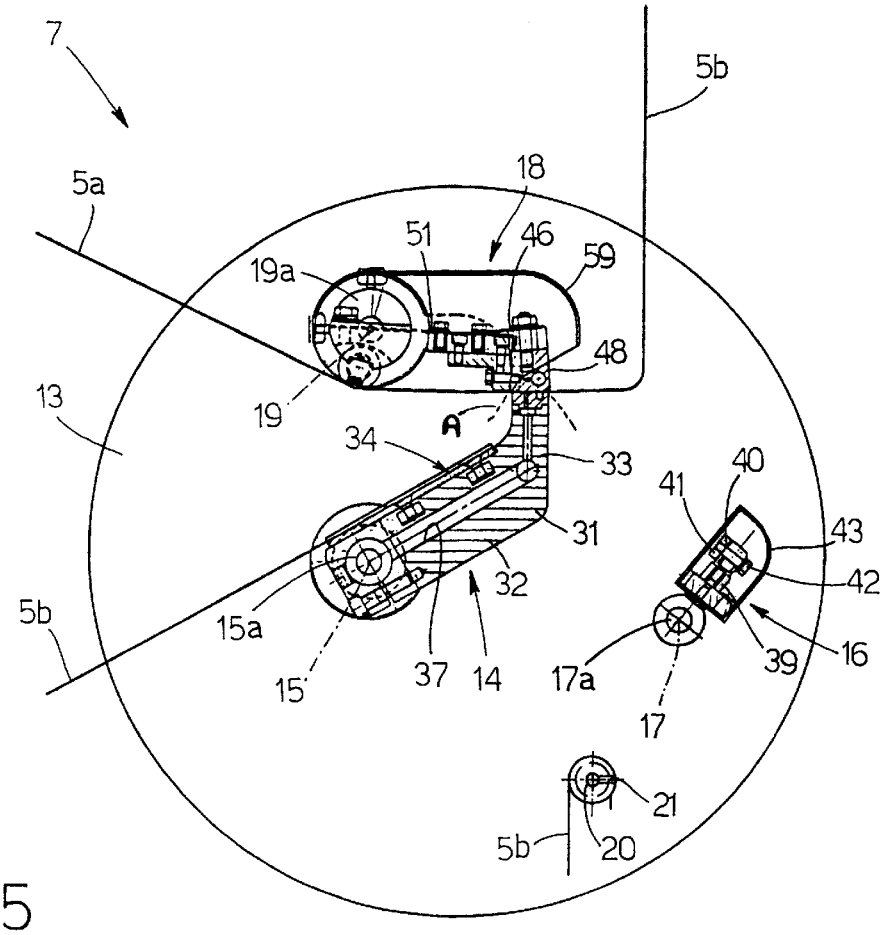
Figure 5A:
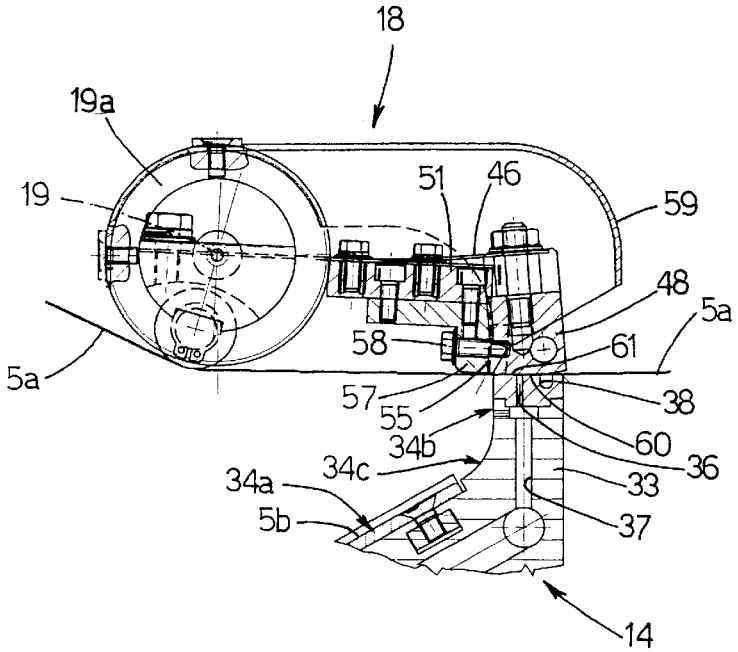

As shown in FIGS. 4*a*, 5*a* and 7, tool 18 also comprises two blades 51 and 52, which project with respect to pin 19*a*, extend in the same direction as blade 44, and are coplanar with blade 44. Blades 51 and 52 are fitted to pin 19*a* and have respective free ends supporting respective fastening assemblies 53 and 54, between which extends a wire 55 of conducting material which is heated by electric current to a temperature ranging between 100° C. and 150° C. With respect to axis 19, blades 51 and 52 are shorter in length than appendixes 46 and 47, so that wire 55 engages groove 50 when tool 18 is in the rest position. That is, with tool 18 in the rest position, wire 55 is located between axis 19 and heat-seal block 48, and is substantially adjacent to block 48.

Each fastening assembly 53, 54 comprises an insulating body 56 fitted to respective blade 51, 52; and an insulating block 57 fastened to respective body 56 by a screw 58 to retain the ends of wire 55.

As shown in FIGS. 3, 3*a*, 5 and 5*a*, tool 18 also comprises a fume hood 59 fitted to pin 19*a* and extending over heat-seal block 48 and blade 44.

In actual use, device 7 splices strips 5*a* and 5*b* in the steps shown in FIGS. 2 to 6 and 2*a* to 6*a*. In FIGS. 2 and 2*a*, strip 5*a* is fed through device 7 to store 8 along path Pa, and strip 5*b* extends along path Pb between reel 4*b* and device 7, and rests on surfaces 34 and 35 of lever 14, and on pin 20 which retains the end of strip 5*b* by means of suction holes 21. At this step, cutting tool 16 is moved into the work position shown in FIG. 2, in which wire 40, fed along a trajectory G, intercepts strip 5*b* extending along path Pb. Along trajectory G, wire 40 is brought into contact with, and burns and melts, the portion of strip 5*b* at groove 38 to detach from strip 5*b* a portion 60 of strip 5*b* extending between groove 38 and pin 20, and which is then removed by the operator. Wire 40 is housed inside groove 38 and does not come into contact with arm 31.

As shown more clearly in FIGS. 3 and 3*a*, strip 5*b* therefore now has a new end located precisely and directly at groove 38 and along end surface 35. That is, portion 60 extends between groove 38 and the edge between portion 34*b* and surface 35, and directly contacts surface 35. The small amount of fumes generated by wire 40 burning strip 5*b* is retained and fed by fume hood 43 to a fume exhaust conduit (not shown).

With reference to FIGS. 3 and 3*a*, cutting tool 16 is rotated clockwise, in FIG. 3, about axis 17 back into the rest position; and lever 14 is rotated anticlockwise, in FIG. 3, about axis 15 into a work position wherein surface 35 is substantially parallel to and separated by a fairly small distance from strip 5*a*, so that portion 60 of strip 5*b* contacting surface 35 is also positioned parallel to and separated by the same small distance from strip 5*a*.

Supply of strip 5*a* between reel 4*a* and store 8 is then arrested, so that a portion 61 of strip 5*a* is located directly over portion 60.

As shown in FIG. 4, tool 18 is rotated clockwise, in FIG. 4, about axis 19 into a work position, so that surface 49 of heat-seal block 48 is brought into contact with strip 5*a*, and portion 61 of strip 5*a* is brought into contact with portion 60 of strip 5*b* resting on supporting surface 35 of arm 31. That is, portions 60 and 61 are sandwiched between arm 31 and heat-seal block 48, which is heated to a temperature ranging between 100° C. and 120° C. to transmit a given amount of heat to and so seal portions 60 and 61 to each other.

Given the curved shape of surface 49 of block 48 and the substantially flat shape of surface 35 of arm 31, block 48 is brought to rest on arm 31 along only one generating line of surface 49, and with no direct contact, on account of portions 61 and 60 of respective strips 5*a* and 5*b* being interposed between surface 35 and surface 49. As shown in FIGS. 5 and 6, pin 19*a* is rotated further clockwise, in FIG. 5, about respective axis 19, so that, seeing as any movement of block 48 clockwise, in FIG. 5, is prevented by arm 31, appendixes 46 and 47 of blade 44 are flexed into an upwardly-concave position; the further rotation of pin 19*a* and the deformation of appendixes 46 and 47 cause block 48 to roll surface 49 with respect to surface 35 of arm 31 to bring successive generating lines into contact with surface 35; and the further rotation of pin 19*a* causes wire 55 to rotate clockwise, in FIGS. 5 and 6, about axis 19 and along a circular trajectory A (FIG. 5) with respect to block 48. Along trajectory A, wire 55 is extracted from groove 50 and is fed towards and intercepts strip 5*a* to detach portion 61 of strip 5*a* from strip 5*a* attached to reel 4*a*. Strip 5*b* on the other hand is retained along surface 34 of arm 31 and relatively far from wire 55 by known suction holes (not shown), and is also maintained at a safe distance from wire 55 by the shape of surface 34.

Figure 6:
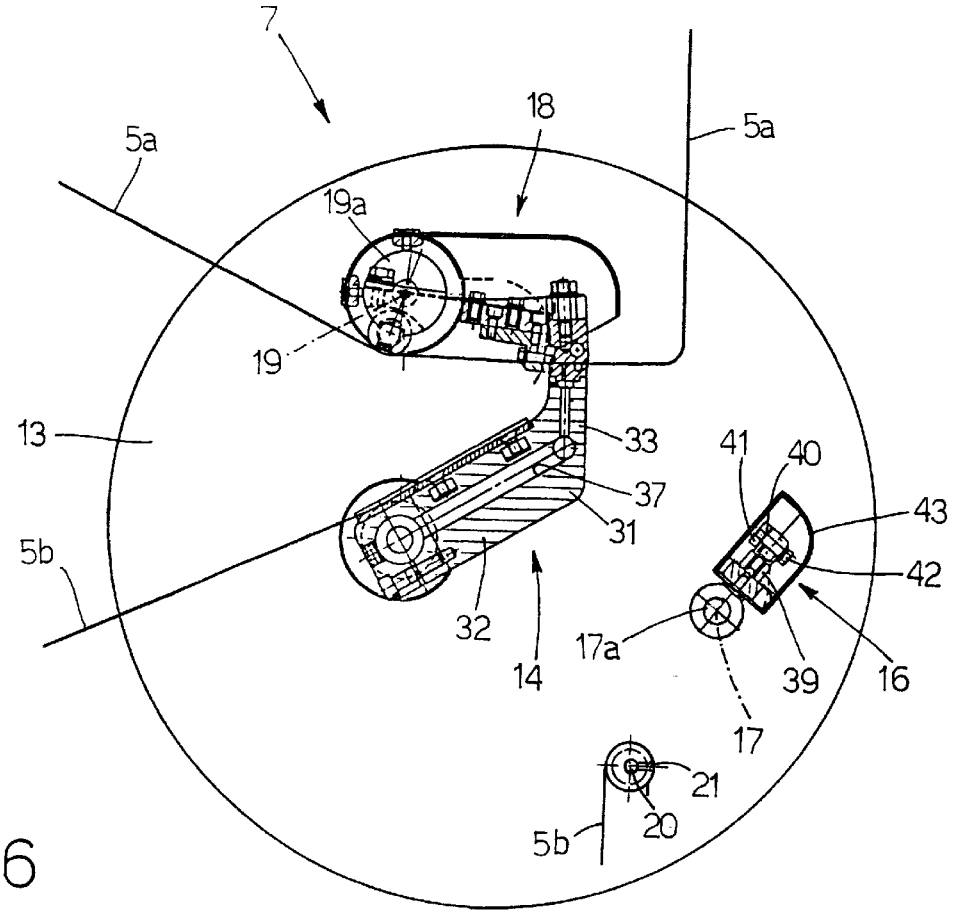
Figure 6A:
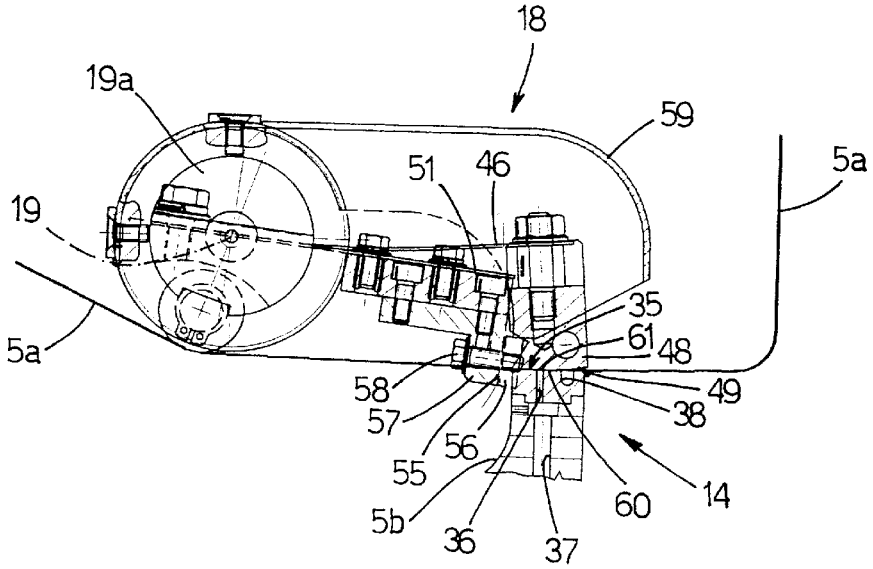

Once portions 60 and 61 are heat-sealed and strip 5*a* cut, tool 18 is rotated anticlockwise, in FIG. 6, about axis 19 back into the FIG. 2 rest position; in the meantime, the known suction holes (not shown) along surface 34, and suction holes 36 along surface 35 are disabled to free strip 5*b*, which extends between reel 4*b* and store 8 and is fed to store 8; and, with reference to FIG. 1, platform 9 is rotated 180° anticlockwise to invert the positions of reels 4*b* and 4*a* so that strip 5*b* extends along path Pa.

Figure 8:
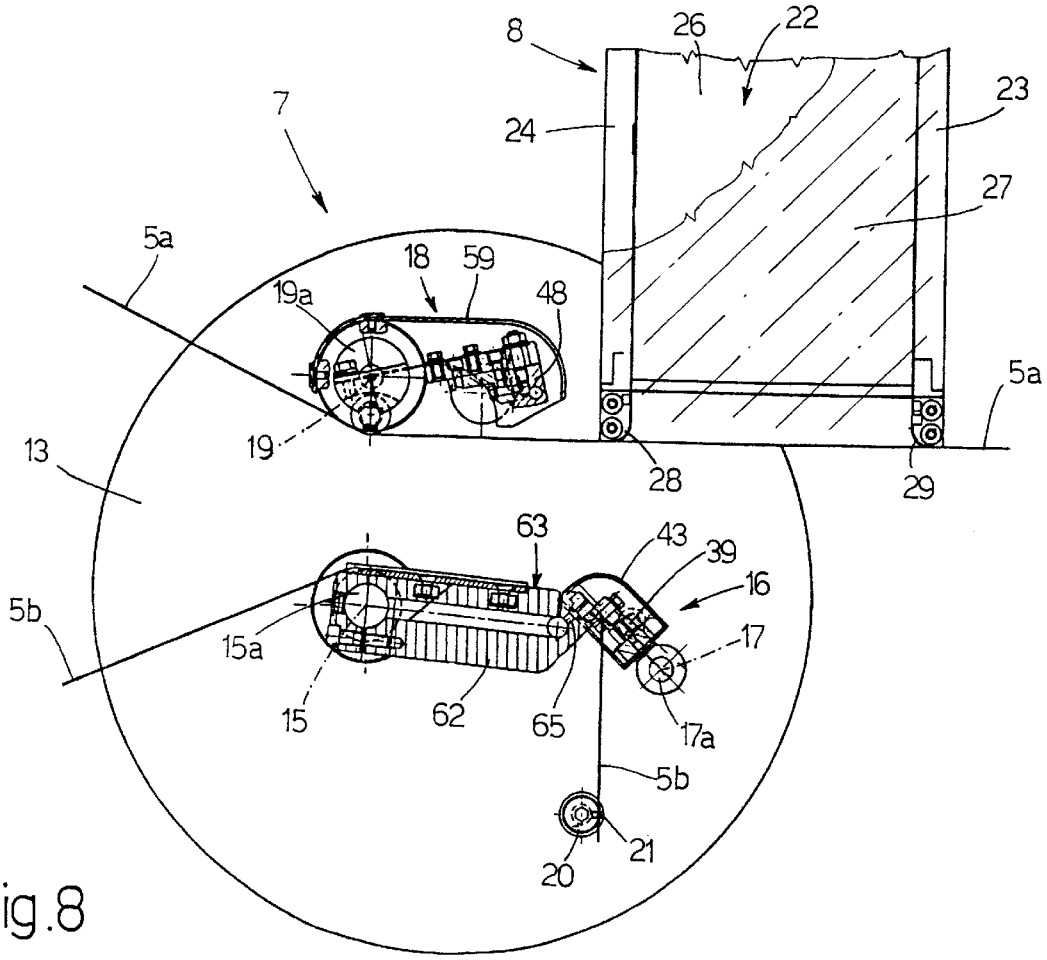
FIG. 8 shows a schematic side view of a variation of the device according to the invention.
Figure 8A:
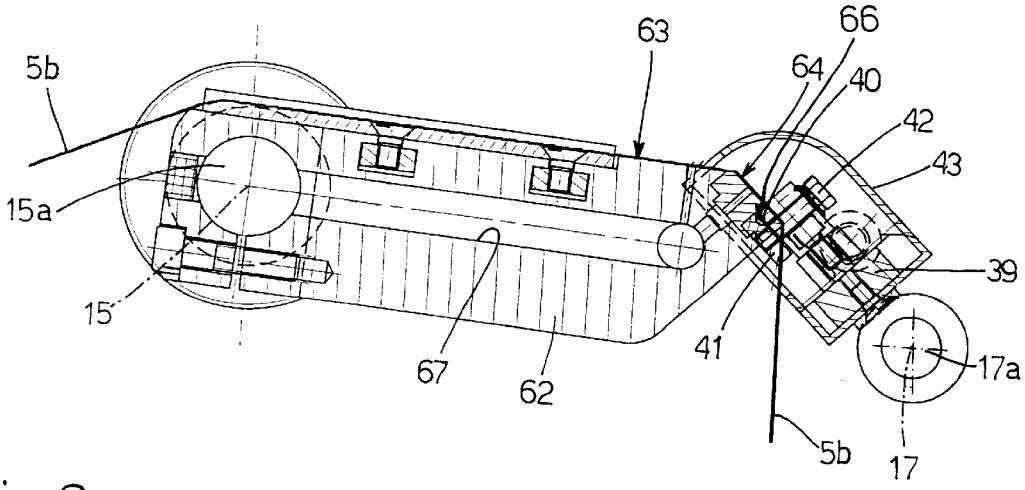
FIG. 8*a* is an enlarged version of a detail from FIG. 8.

In the FIG. 8 variation, arm 31 is omitted, and lever 14 comprises an arm 62, which is fitted to pin 15*a*, extends substantially radially with respect to axis 15, and comprises a substantially flat lateral surface 63 and an end surface 64. A number of known suction holes (not shown) are distributed along surface 63; a number of suction holes 65 are distributed along surface 64, which forms a given angle with surface 63 and comprises a groove 66 perpendicular to the FIG. 8 plane; and arm 62 comprises a conduit 67 connecting holes 65 to a known suction device (not shown).

Arm 62 in the FIG. 8 variation is simplified with respect to curved arm 31, and may be used when working with a strip 5*b* made of material which is not damaged by temporary proximity to wire 55 at a temperature ranging between 100° C. and 150° C.

Besides involving none of the complications posed by a blade and counterblade, the present invention is particularly advantageous by enabling precise cuts directly at splicing portions 60 and 61, and so preventing the various stations of cellophaning machine 1 from being supplied with portions of strip 5*a*, 5*b* attached to respective portions 60 and 61 but not heat sealed to each other, and which may therefore possibly result in stoppage of machine 1.

What is claimed is:

1. A device for splicing strips of thermoplastic material to splice at least a first strip (5*a*) extending along a first path (Pa), and a second strip (5*b*) extending along a second path (Pb); the device (7) comprising first supporting and guide means (18) for the first strip (5*a*), and second supporting and guide means (14) for the second strip (5*b*), the first and second supporting and guide means (18, 14) being movable with respect to each other to bring together a portion (61) of the first strip (5*a*) and a portion (60) of the second strip (5*b*); a heat-seal block (48) movable between a rest position and a work position to grip and heat seal said portions (61; 60) of the first and second strips (5*a*, 5*b*) between said heat-seal block (48) and said second supporting and guide means (14); and movable cutting means (55) for intercepting and cutting at least one of said first and second strips (5*a*, 5*b*); wherein said cutting means (55) comprises a heatable element (55) which is brought into contact with said at least one of said first and second strips (5*a*, 5*b*) to melt a portion of said at least one of said first and second strips (5*a*, 5*b*); said heatable element (55) comprising a first wire (55) made of conductive material and movable along a given first trajectory (A) intercepting said first path (Pa) to cut said first strip (5*a*), said first supporting and guide means (18) comprising a heat-seal and cutting tool (18) rotatable about a first axis (19) and comprising said first wire (55) and said heat-seal block (48) parallel to said first wire (55); said first wire (55) being located at a relatively small distance with respect to said heat-seal block (48).

2. A device as claimed in claim 1, wherein said first wire (55) is located between a pair of first arms (51, 52); said first arms (51, 52) being rotatable about said axis (19) parallel to said first wire (55) to feed said first wire (55), parallel to itself, along the given said first trajectory (A).

3. A device as claimed in claim 1, wherein said heat-seal block (48) is carried by a flexible second arm (44); said second arm (44) being rotatable with respect to the first axis (19).

4. A device as claimed in claim 3, wherein said second arm (44) is fitted to a first pin (19*a*) rotatable with respect to the first axis (19); said first arms (51, 52) being fitted to said first pin (19*a*), on opposite sides of said second arm (44).

5. A device as claimed in claim 1, wherein the second supporting and guide means (14) comprises a lever (14) rotatable about a second axis (15) parallel to said first axis (19), and movable between a rest position and a work position; said second strip (5*b*) contacting said first strip (5*a*) in said work position.

6. A cellophaning machine comprising a device (7) as claimed in claim 1, wherein said device (7) is located between a reel-change device (3) and a store (8) for storing at least one of said first and second strips (5*a*; 5*b*).

7. A device for splicing strips of thermoplastic material to splice at least a first strip (5*a*) extending along a first path (Pa), and a second strip (5*b*) extending along a second path (Pb); the device (7) comprising first supporting and guide means (18) for the first strip (5*a*), and second supporting and guide means (14) for the second strip (5*b*), the first and second supporting and guide means (18, 14) being movable with respect to each other to bring together a portion (61) of the first strip (5*a*) and a portion (60) of the second strip (5*b*); a heat-seal block (48) movable between a rest position and a work position to grip and heat seal said portions (61; 60) of the first and second strips (5*b*, 5*b*) between said heat-seal block (48) and said second supporting and guide means (14); and movable cutting means (55) for intercepting and cutting at least one of said first and second strips (5*a*, 5*b*); wherein said cutting means (55) comprises a heatable element (55) which is brought into contact with at least one of said first and second strips to melt a portion of said at least one of said strips (5*a*, 5*b*); the device further comprising a cutting tool (16) for removing a surplus portion of the second strip (5*b*); said surplus portion extending between said second supporting and guide means (14) and a pin (20) for retaining an end of said second strip (5*b*); said cutting tool (16) comprising a second wire (40) made of heatable conductive material and movable along a second trajectory (G); said second wire intercepting said second strip (5*b*) extending along the second path (Pb) to detach said surplus portion of the second strip (5*b*); said lever (14) comprising a third arm (31; 62) having an end surface (35; 64) which cooperates with said cutting tool (16) when said lever (14) is in the rest position; said third arm (31, 62) comprising a groove (38; 66) formed along said end surface (35; 64) and parallel to said second axis (15); said second wire (40) occupying said groove (38; 66).

* * * * *